US007036343B1

(12) United States Patent
Wei

(10) Patent No.: US 7,036,343 B1
(45) Date of Patent: May 2, 2006

(54) STRIPING APPARATUS OF A CIRCULAR KNITTING MACHINE

(75) Inventor: Chih-Liang Wei, Taipei Hsien (TW)

(73) Assignee: Pai Lung Machinery Co., Ltd., Taipei Hsien (TW)

( * ) Notice: Subject to any disclaimer, the term of this patent is extended or adjusted under 35 U.S.C. 154(b) by 0 days.

(21) Appl. No.: 11/267,167

(22) Filed: Nov. 7, 2005

(51) Int. Cl.
*D04B 15/58* (2006.01)

(52) U.S. Cl. ..... 66/140 R; 66/134

(58) Field of Classification Search ..... 66/133–135, 66/138, 139, 140 R, 140 S, 141–144, 145 R
See application file for complete search history.

(56) References Cited

U.S. PATENT DOCUMENTS 4,656,842 A * 4/1987 Sawazaki et al. ..... 66/139
5,070,709 A 12/1991 Guell
5,218,845 A 6/1993 Wang
6,000,245 A * 12/1999 Plath et al. ..... 66/139
6,058,742 A * 5/2000 Dalmau Guell ..... 66/140 R
6,408,655 B1 * 6/2002 Ossensi et al. ..... 66/140 R
6,655,176 B1 12/2003 Wang

* cited by examiner

*Primary Examiner*—Danny Worrell
(74) *Attorney, Agent, or Firm*—Birch, Stewart, Kolasch & Birch, LLP

(57) ABSTRACT

The present invention relates to a striping apparatus of a circular knitting machine, comprising: a selector, a controller, a yarn-feed unit, and a drive unit. The yarn-feed unit has two portions; the first portion includes a yarn-changing plate, which feeds a yarn into a yarn-entering position, and the second portion includes a movable blade, which clips the tail of the yarn when standby and cuts off an old yarn so that the old yarn can depart from fabric when changing yarns and the operation can back to the standby state. In the preferred embodiments of the present invention, different cams respectively drive the yarn-changing plate and the movable blade, and even though a new yarn and an old yarn are farther spaced, the timings of the cams can be adjusted to release the tail of new the yarn from the movable blade before it is torn off.

5 Claims, 14 Drawing Sheets

STRIPING APPARATUS OF A CIRCULAR KNITTING MACHINE

FIELD OF THE INVENTION

The present invention relates to a striping apparatus of a knitting machine, particularly to a striping apparatus of a circular knitting machine.

BACKGROUND OF THE INVENTION

There are striping apparatus technologies of circular knitting machines well known to people, such as U.S. Pat. No. 6,655,176 "Striping Apparatus For Circular Knitting Machines" and U.S. Pat. No. 5,070,709 "Striping System For Circular Knitting Machine", which respectively disclose striping apparatuses feeding different yarn into the knitting needle of a knitting machine. Besides, U.S. Pat. No. 5,218,845 "Circular Knitting Machine Striper Control System" discloses a controller for a striping apparatus.

As shown in from FIG. 1A to FIG. 1D, the striper structure of the abovementioned U.S. Pat. No. 5,218,845 comprises: yarn-changing plates 10; movable blades 11; and drive elements (not shown in the drawings), used to drive the yarn-changing plates 10 and the movable blades 11. In normal state, the yarn-changing plate 10 is at a non-enable normal position, and the movable blade 11 also withdraws back to the main body 12, and a hook 110 clips the yarn to position at the front edge 120 of the main body 12. As shown in FIG. 1B, when the machine begins to feed yarns, the drive element pushes the yarn-changing plate 10, and then, the front end of the yarn-changing plate 10 extends outward. Simultaneously, the rear end 101 of the yarn-changing plate 10 touches a first pin 111 of the movable blade 11 to drive the movable blade 11 toward the left side of the FIG. 1C until the yarn-changing plate 10 reaches an external yarn-feed position, and then, the hook 110 of the movable blade 11 releases a yarn Y, as shown in FIG. 1C. Naturally, before the hook 110 releases the yarn Y, the yarn-changing plate 10 has transferred the yarn Y to the yarn-feed position, and a knitting needle 13 hooks the yarn Y to perform knitting operation.

Lastly, when yarn is intended to change, the yarn-changing plate 10, which has reached the external yarn-feed position beforehand, will be pulled by the drive element back to the normal position, as shown in FIG. 1A. During the process that the yarn-changing plate 10 moves to the right side of FIG. 1D, a nose 102 of the yarn-changing plate 10 will touch a second pin 112 of the movable blade 11 and actuate the movable blade 11 to move rightward and back to the normal position, and then, the hook 110 of the movable blade 11 will cut off the yarn Y and clip the tail of the yarn Y at the front edge 120 of the main body 12.

In general, such a striping apparatus can provide multiple different colors of yarns; for example, the four-color striping apparatus has four sets of parallel-arranged yarn-changing plates 10 and movable blades 11 to change four kinds of yarns respectively, and it is the same for the six-color striping apparatus; the more the number of yarns, the greater the width of the striping apparatus. In the striping apparatus disclosed in the abovementioned U.S. Pat. No. 5,218,845, as the movable blade 11 is driven by the yarn-changing plate 10, the time that the yarn-changing plate 10 touches the second pin 112 of the movable blade 11 is later than the time that the drive element begins pushing the yarn-changing plate 10 toward the normal position. Such a design that both the yarn-changing plate 10 and the movable blade 11 are driven by an identical drive element will bring about the delay of the time that the movable plate 11 cuts off the yarn Y. In such a design that both the yarn-changing plate 10 and the movable blade 11 are driven by an identical drive element, when an old yarn and a new yarn, e.g. a yarn 1 and a yarn 6, are spaced farther, the time difference between two actions increases because of the larger spacing therebetween, and the time of releasing the yarn Y is too late so that the yarn will be torn off when the tail of the yarn is still clipped by the movable blade 11 and a yarnlet Y1 will still remain clipped, as shown in FIG. 1B; then, the yarnlet Y1 will be released and tangled with fabric; therefore, fabric quality is degraded.

SUMMARY OF THE INVENTION

The primary objective of the present invention is to provide a striping apparatus of a circular knitting machine in order to avoid the appearance of yarnlets and improve fabric quality.

According to one scheme of the present invention, different cams are separately used to drive the yarn-changing plate and the movable blade, and even though a new yarn and an old yarn are farther spaced, the timings of the cams can be adjusted to rapidly withdraw the old yarn and cut it off and to release the tail of the new yarn from the movable blade before it is torn off. Thereby, the present invention can prevent a yarn from being torn off lest yarnlets appear, so that fabric quality can be improved.

The technical contents and preferred embodiments of the present invention are to be described below in detail in cooperation with the drawings.

DETAILED DESCRIPTION OF THE PREFERRED EMBODIMENTS

Figure 1A:
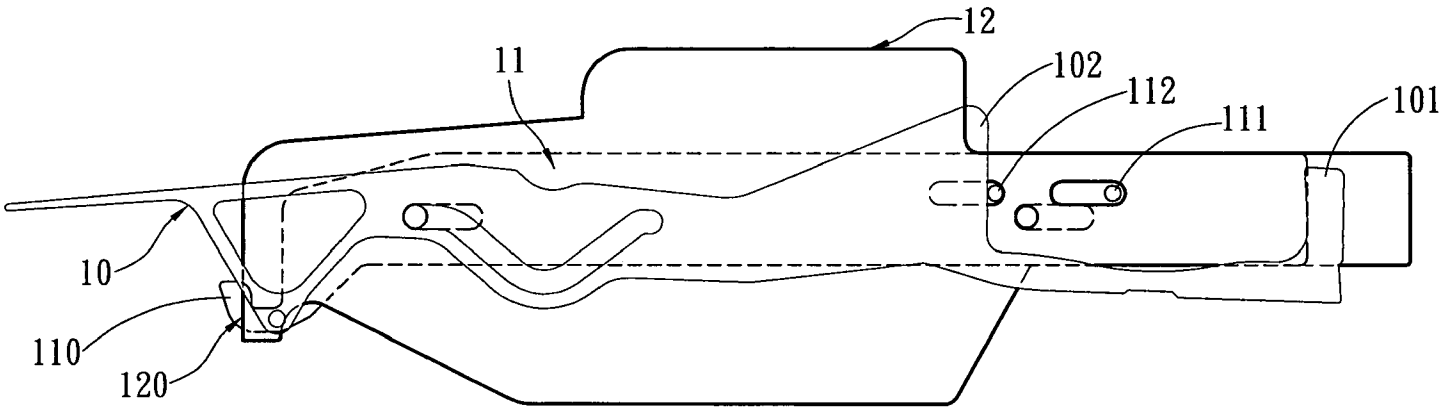
Fig. 1A PRIOR ART
FIG. 1A to FIG. 1D are schematic views showing the structure of a conventional striping apparatus and the operation of the yarn-changing plate and the movable blade.
Figure 1B:
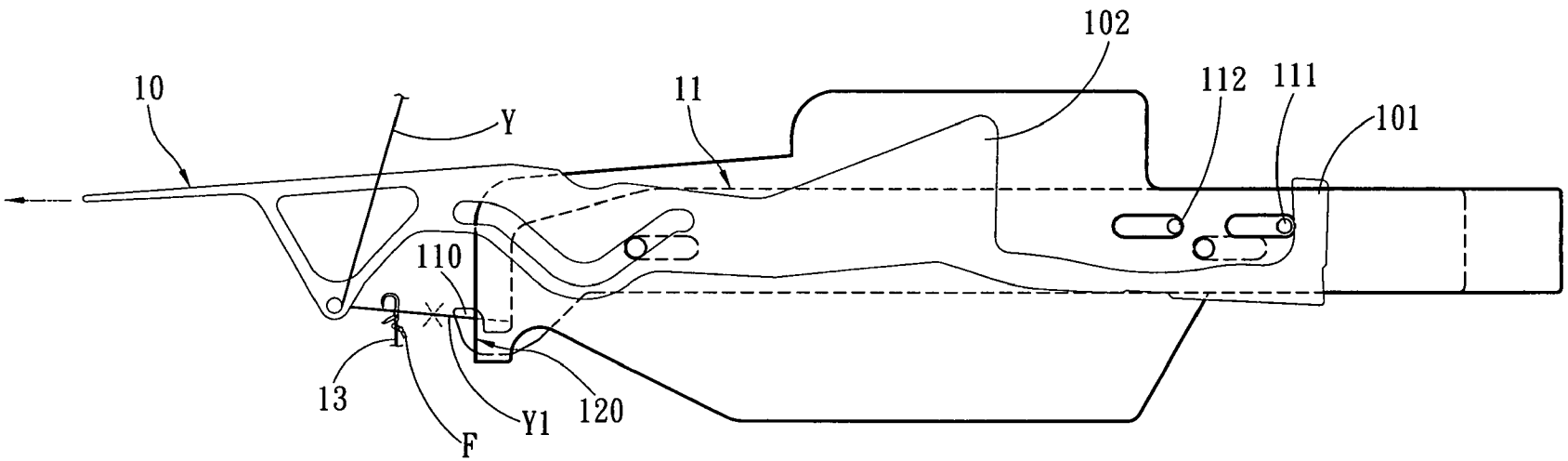
Fig. 1B PRIOR ART
Figure 1C:
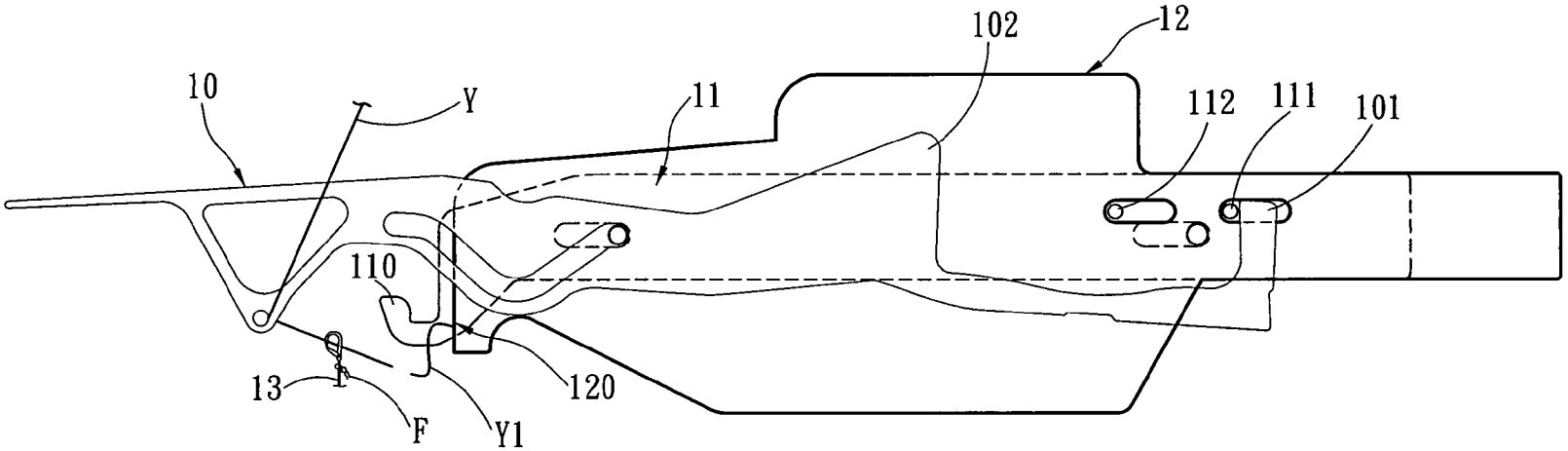
Fig. 1C PRIOR ART
Figure 1D:
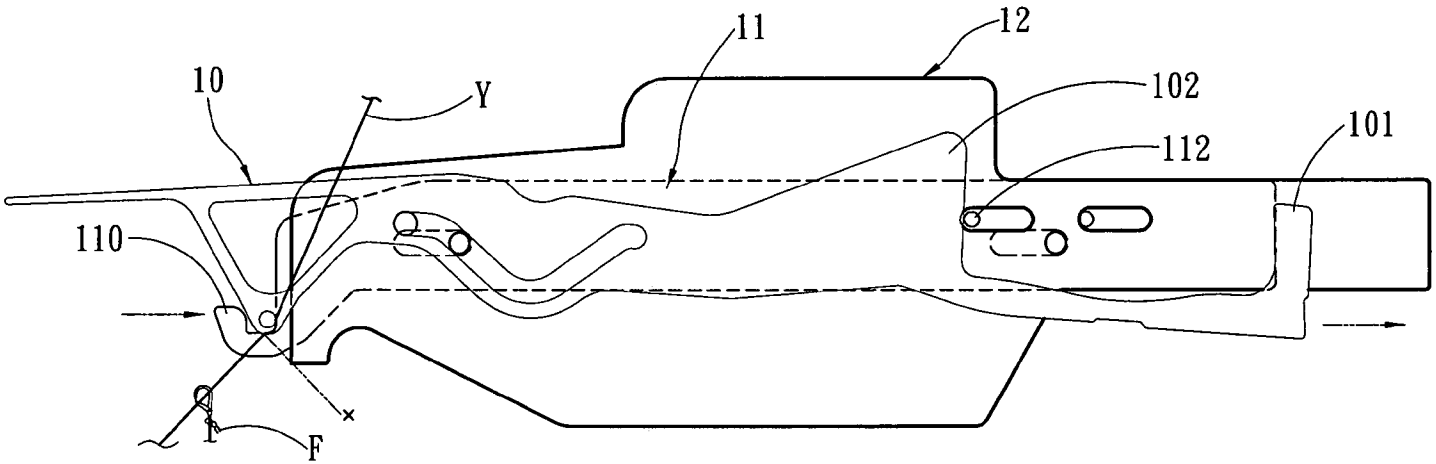
Fig. 1D PRIOR ART
Figure 2:
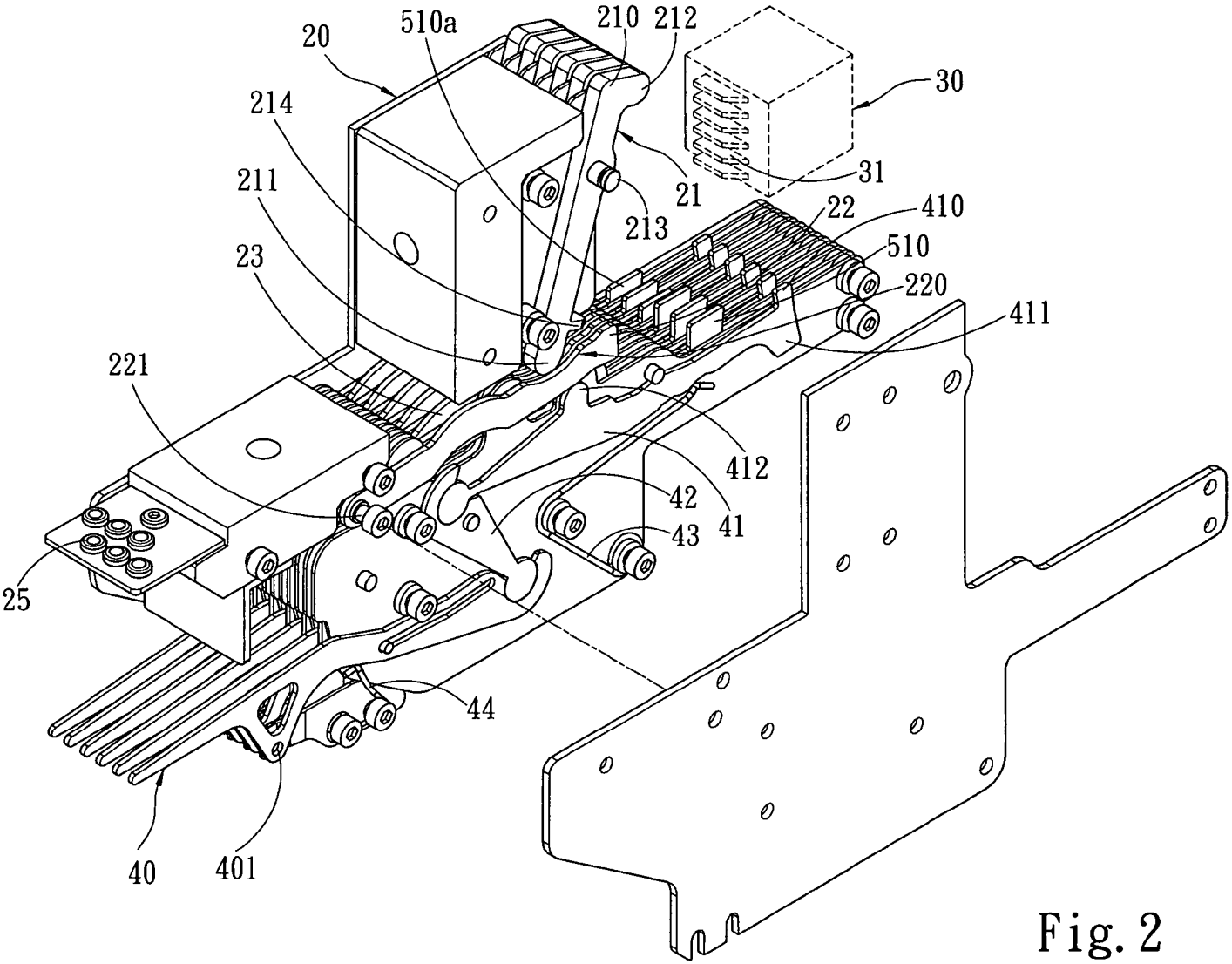
FIG. 2 is a schematic view showing a preferred embodiment of the striping apparatus of the present invention.

Refer to FIG. 2. According to one preferred embodiment, the striping apparatus of a circular knitting machine of the present invention comprises: a controller 20, a yarn-feed unit and a drive unit. The controller 20 is driven by a selector 30, which rotates around the knitting portion of the circular knitting machine. The selector 30 is a kind of electronic device functioning like cams and having multiple movable elements 31, which are normally non-enable. Under the control of a control circuit or a central computer, the movable elements 31 can move to a triggering position. When the selector 30 passes the nearby of the controller 20, the movable elements 30 at the triggering position will actuate corresponding triggers 21 of the controller 20 to move to an enable position.

Figure 4A:
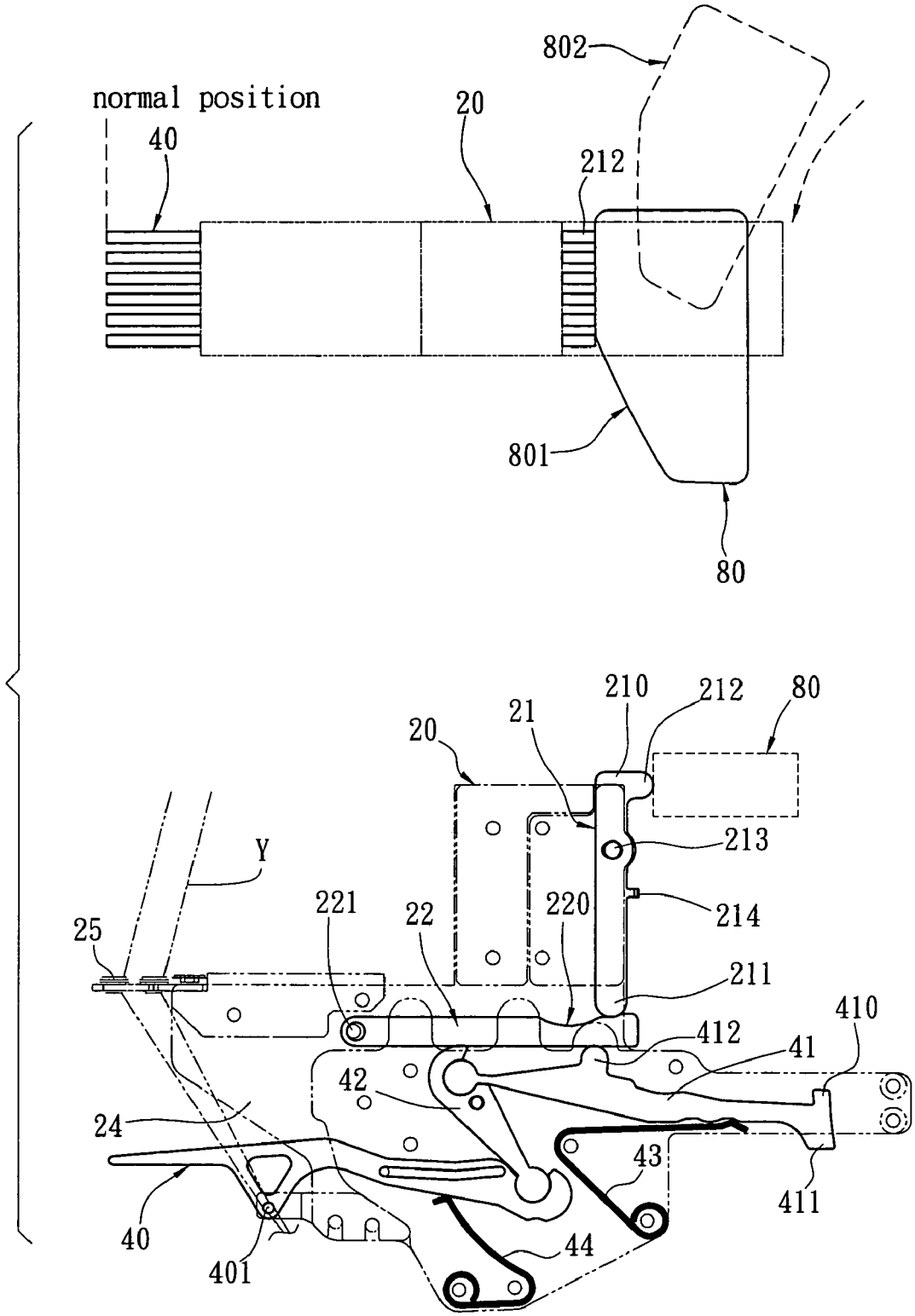
FIG. 4A is a schematic view showing the first portion of the yarn-feed unit at the normal position.
Figure 4B:
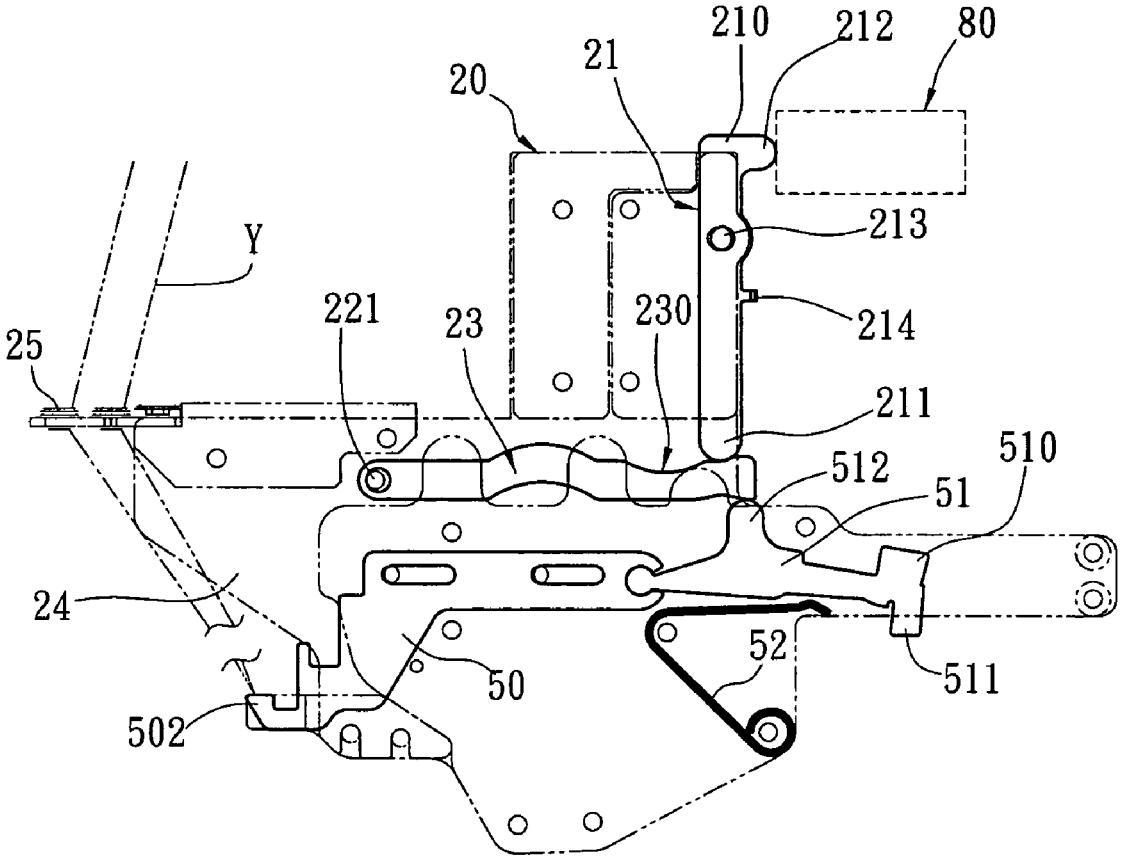
FIG. 4B is a schematic view showing the second portion of the yarn-feed unit at the normal holding position.

The controller 20 further comprises: triggers 21, first safety levers 22 and second safety levers 23. One end of the first safety lever 22 and one end of the second safety lever 23 are installed to a sideboard 24 with a first pivotal shaft 221. The trigger 21 has a first end 210 and a second end 211; the first end 210 of the trigger 21 has a protrudent return nose 212; the portion between the first end 210 and the second end 211 has a second pivotal shaft 213, and the triggers 21 are installed to the sideboard 24 with the second pivotal shaft 213; and the second end 211 of the triggers 21 also has a protrudent second nose 214. Refer to FIG. 4A and FIG. 4B. When in normal state, the trigger 21, the first safety lever 22, and the second safety lever 23 are all at a lock position; the second end 211 of the trigger 21 presses against the first safety lever 22 and the second safety lever 23. When the first end 210 of the trigger 21 is moved by an external force, it will rotate around the second pivotal shaft 213 to the enable position, and the second end 211 of the trigger 21 will slide into a notch 220 at the top side of the first lever 22 and a notch 230 at the top side of the second lever 23, which enables the first lever 22 and the second lever 23 swing around the first pivotal shaft 221 upward to an unlock position. The entire controller 20 comprises multiple units, and each unit is formed of one trigger 21, one first safety lever 22, and one second safety lever 23; those units are parallel arranged into the entire controller 20. When in normal state, the relationship between the trigger 21 and the first safety lever 22 of the same unit is shown in FIG. 4A, and the relationship between the trigger 21 and the second safety lever 22 of the same unit is shown in FIG. 4B.

The yarn-feed unit is fixedly installed in the perimeter of the circular knitting machine and comprises two portions. The first portion further comprises: yarn-changing plates 40, first connecting rods 41, and second connecting rods 42. The first portion functions to feed a yarn Y to a yarn-entering position. The second port further comprises: movable blades 50 and a driving link 51. The second port functions to clip the tail of the yarn Y when standby and to cut off an old yarn, so that the old yarn can be released from fabric and the operation can restore standby state. The abovementioned controller 20 is fixedly installed above the yarn-feed unit, and the preferred embodiments of them are described below.

Figure 5A:
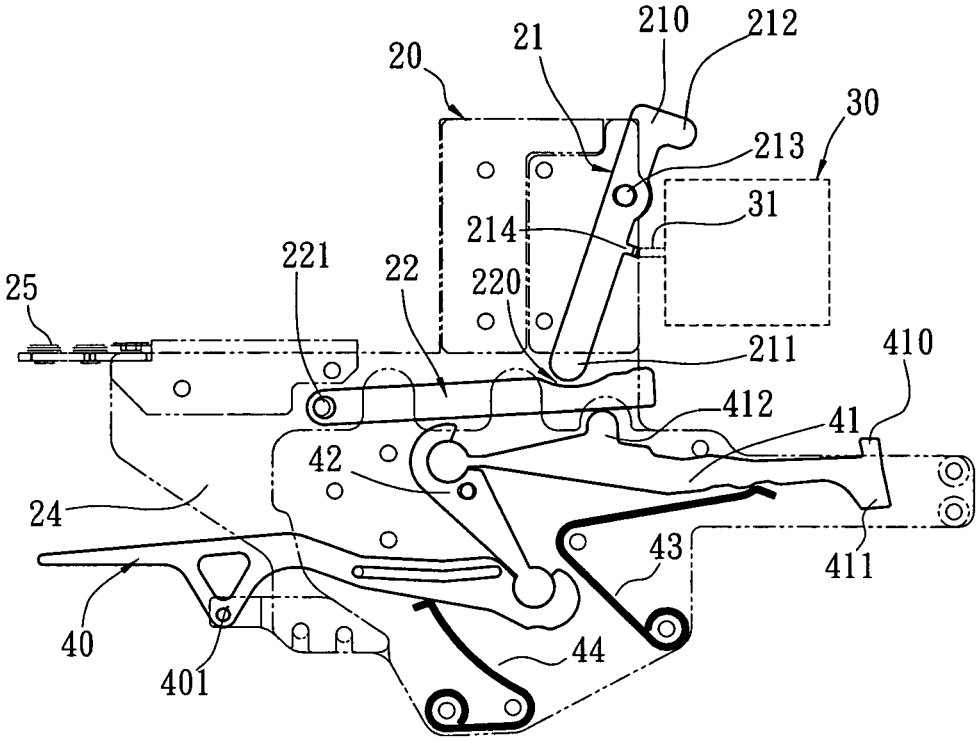
FIG. 5A, FIG. 5C, FIG. 5E and FIG. 5G are schematic views showing the sequential operational steps of the yarn-changing plate of the striping apparatus of the present invention.

The yarn-changing plates 40, first connecting rods 41, and second connecting rods 42 of the first portion interconnect head to tail to form a kind of three-bar linkage. Multiple different colors of yarns Y separately pass different yarn-guiding rings 25 and then pass the through-holes 401 at the front ends of the yarn-changing plates 40. When in normal state, the first connecting rod 41 is like a seesaw, and the tail end of the first connecting rod 41 is coupled to the head end of the second connecting end 42; the upper side of the central portion of the first connecting rod 41 has a protuberance 412; the protuberance 412 contacts the bottom side of the first safety lever 22 normally; the upper side of the head end of the first connecting rod 41 has an upward forward-stroke protuberance 410, and the bottom side of the head end of the first connecting rod 41 has a downward backward-stroke protuberance 411. The tail end of the second connecting rod 42 is coupled to the tail end of the yarn-changing plate 40. The second connecting rod 42 functions to transfer the pulling force of the first connecting rod 41 to the yarn-changing plate 40 and transform the pulling motion of the first connecting rod 41 into a motion of another direction in order to actuate the yarn-changing plate 40 to reciprocate between a normal position (shown in FIG. 4A) and an external position (shown in FIG. 5C). The first portion further comprises: a first elastic element 43 and a second elastic element 44; one end of the first elastic element 43 is fixed to the sideboard 24, and the other end supports the first connecting rod 41 from the bottom side of the head end of the first connecting rod 41. As shown in FIG. 5A, when the trigger 21 shifts to the enable position, the upward pressing force of the first elastic element 43 will push the head end of the first connecting rod 42 upward, and the first safety lever 22 will also move to the unlock position simultaneously, so that the forward-stroke protuberance 410 of the first connecting rod 41 rises above the sideboard 24 to a standby position. The second elastic element 44 supports the yarn-changing plate 40 from the bottom side of the yarn-changing plate 40 in order to complement the first elastic element 43 and provide elastic force for the yarn-changing plate 40.

The tail end of the movable blade 50 is coupled to the tail end of the driving link 51. The upper side of the central portion of the driving link 51 has a protuberance 512, which contacts the bottom side of the second safety lever 23 normally. Both sides of the head end of the driving link 51 separately have an upward forward-stroke protuberance 510 and a downward backward-stroke protuberance 511 in order to actuate the movable blade 50 to reciprocate between a normal holding position (shown in FIG. 4B) and an external release position (shown in FIG. 5D). The second portion further comprises a third elastic element 52; one end of the third elastic element 52 is fixed to the sideboard 24, and the other side supports the driving link 51 from the bottom side near the head end of the driving link 51. When the trigger 21 shifts to the enable position (shown in FIG. 5B), the upward pushing force of the third elastic element 52 will push the head end of the driving link 51 upward, and the second safety lever 23 will also be moved to the unlock position simultaneously, so that the forward-stroke protuberance 510 of the driving link 51 rises above the sideboard 24 to the standby position ready for being pushed out.

Figure 3:
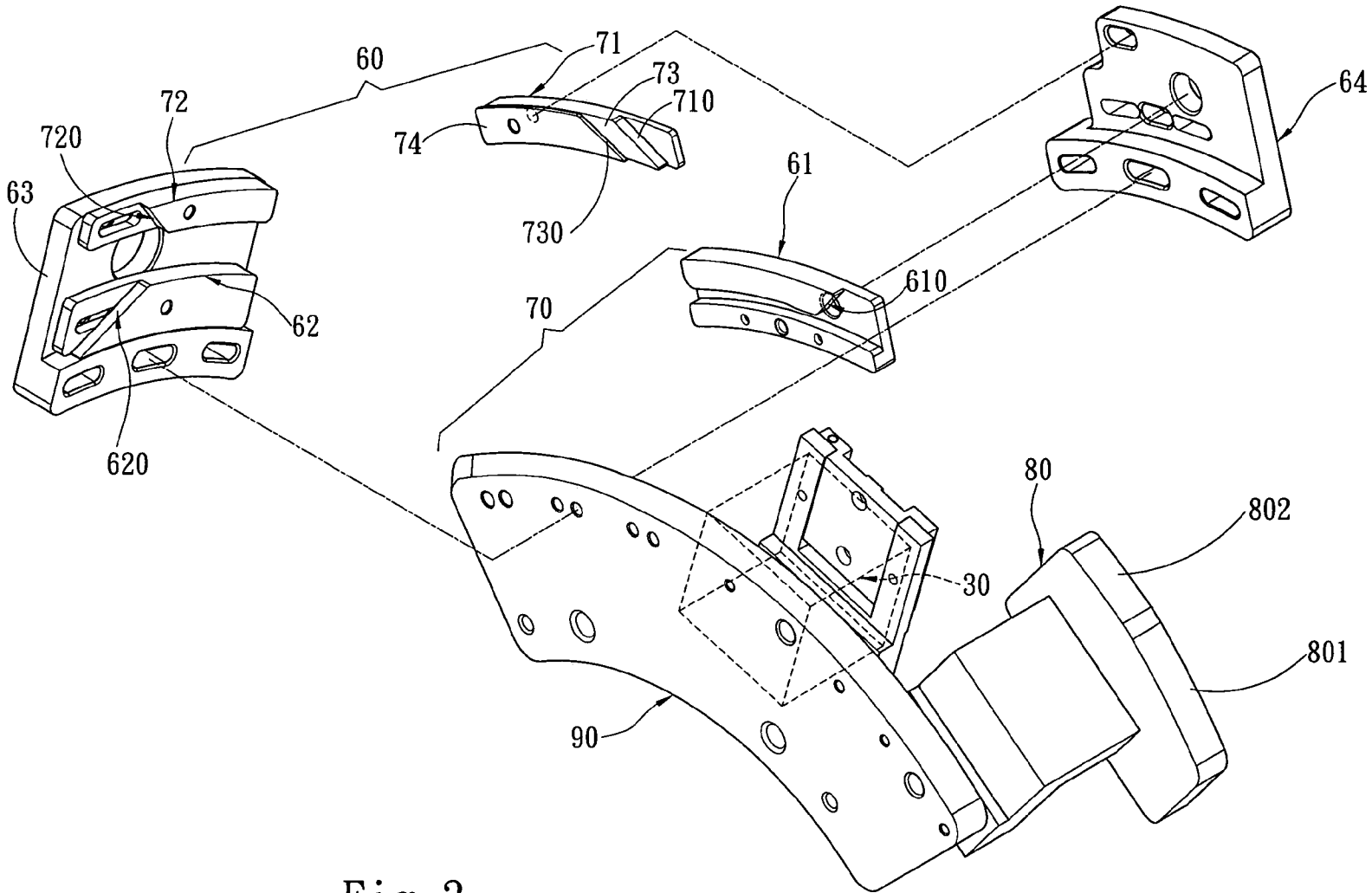
FIG. 3 is a schematic view showing a preferred embodiment of the drive unit of the present invention.

The drive unit further comprises: a first cam set 60, a second cam set 70, and return cams 80, and as shown in FIG. 3, all of them together with the selector 30 are installed to a mount board 90 and rotate around the knitting portion of the circular knitting machine synchronically. The first, second cam sets 60, 70 respectively have forward cams 61, 71 and backward cams 62, 72. The forward cam 61 of the first cam set 60 is responsible for pushing the yarn-changing plate 40 to the external position; the forward cam 71 of the second cam set 70 is responsible for pushing the movable blade 50 to the external release position; the backward cam 62 of the first cam set 60 is responsible for pulling the yarn-changing plate 40 back to the normal non-enable position; the backward cam 72 of the second cam set 70 is responsible for pulling the movable blade 50 for clipping/cutting yarns back to the normal holding position. When in the holding position, a hook 502 at the front end of the movable blade 50 will clip the tail of the yarn Y to position it at between the hook 502 and the sideboard 24.

The practical operation is to be described below in cooperation with from FIG. 5A to FIG. 5H.

Figure 5B:
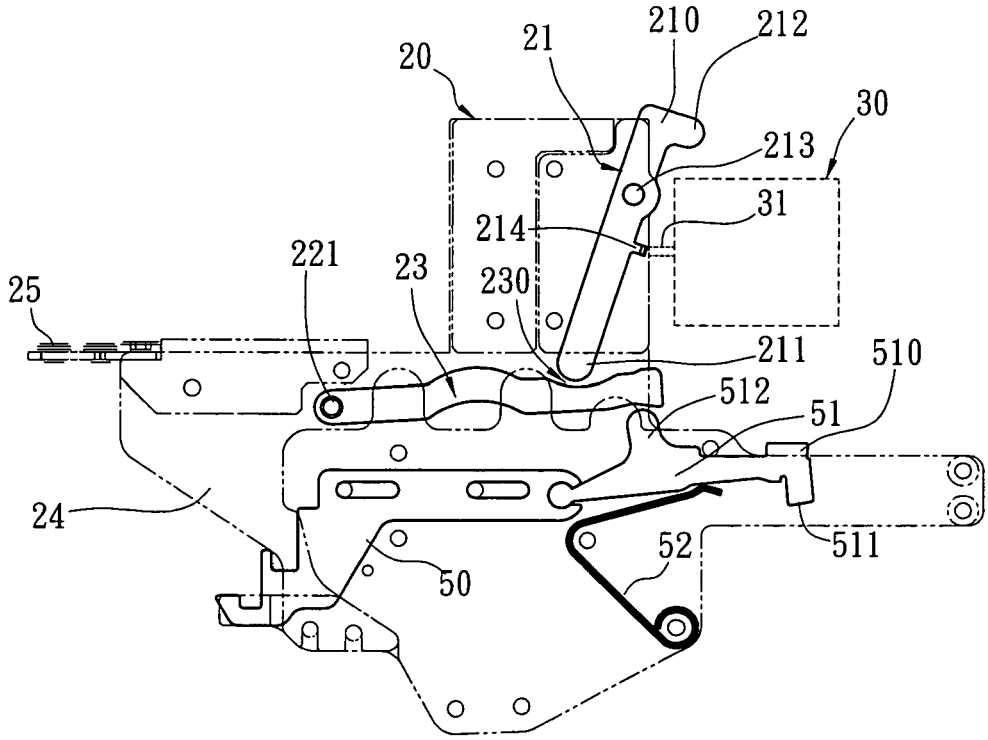
FIG. 5B, FIG. 5D, FIG. 5F and FIG. 5H are schematic views showing the sequential operational steps of the movable blade of the striping apparatus of the present invention.

Firstly, as shown in FIG. 5A, the control circuit or the central computer controls a movable element 31 of the selector 30 to move to a triggering position. When the selector 30 passes the nearby of the controller 20, the movable element 31, which has reached the triggering position, will trigger the second nose 214 of the corresponding trigger 21. The second noses 214 of the triggers 21 are respectively at different heights; therefore, different movable elements 31 of the selector 30 can be used to trigger different second noses 214 of the corresponding triggers 21 separately, so that the corresponding triggers 21 move to the enable positions, and then, the first safety levers 22 move to the unlock positions, so that the forward-stroke protuberance 410 of the first connecting rod 41 rises above the sideboard 24 to the standby position ready for being pushed out. Simultaneously, as shown in FIG. 5B, the forward-stroke protuberance 510 also rises above the sideboard 24 to the standby position ready for being pushed out.

Figure 5C:
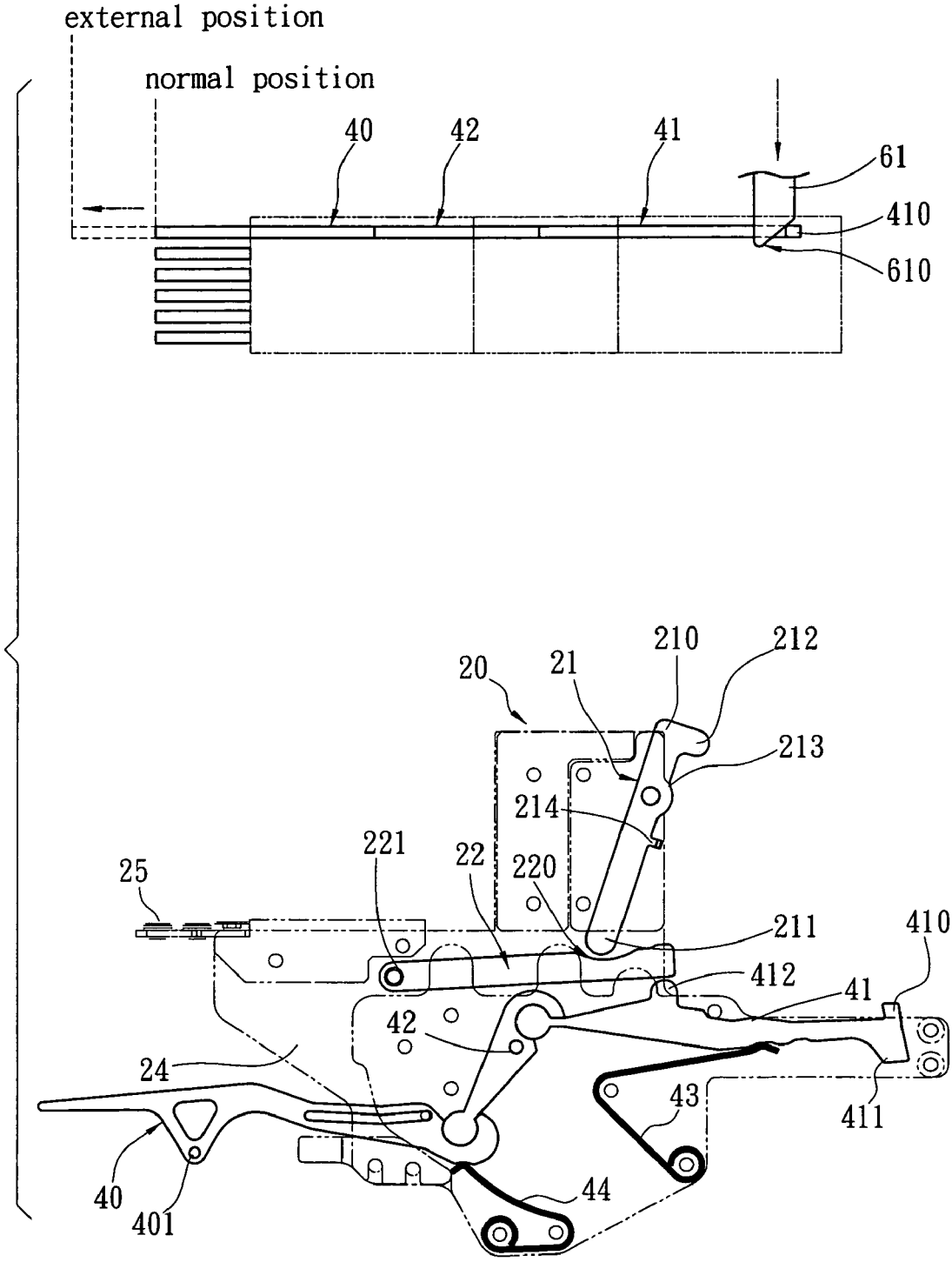
Figure 5D:
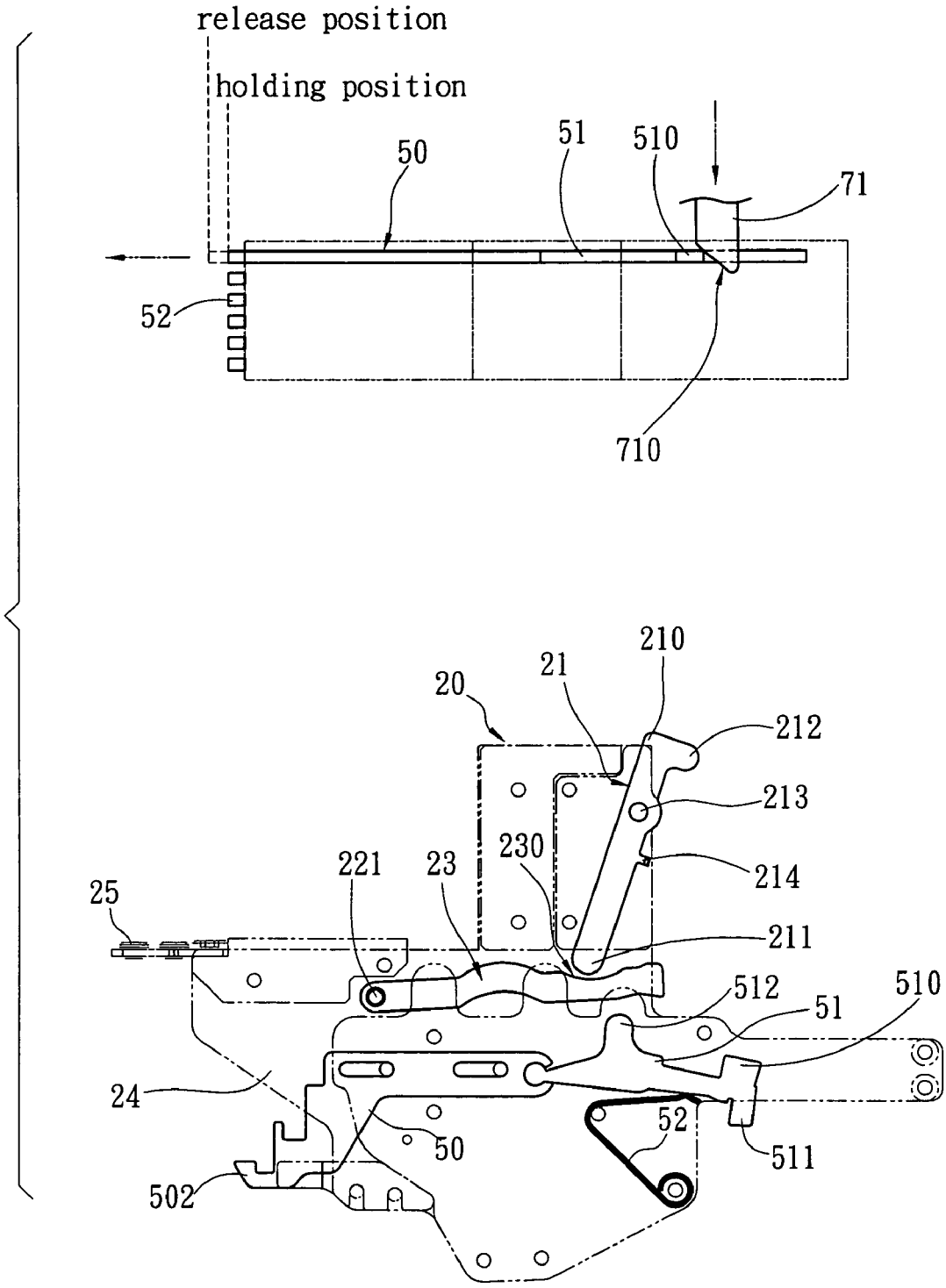

Next, as shown in FIG. 5C, the drive unit moves to the yarn-feed unit, and a first inclined plane 610 of the forward cam 61 of the first cam set 60 touches the forward-stroke protuberance 410 of the first connecting rod 41 to actuate the first connecting rod 41 and the second connecting rod 42 to push the yarn-changing plate 40 to the external position. Further, as shown in FIG. 5D, a first inclined plane 710 of the forward cam 71 of the second cam set 70 touches the forward-stroke protuberance 510 of the driving link 51 to actuate the movable blade 50 to the external release position.

Figure 5E:
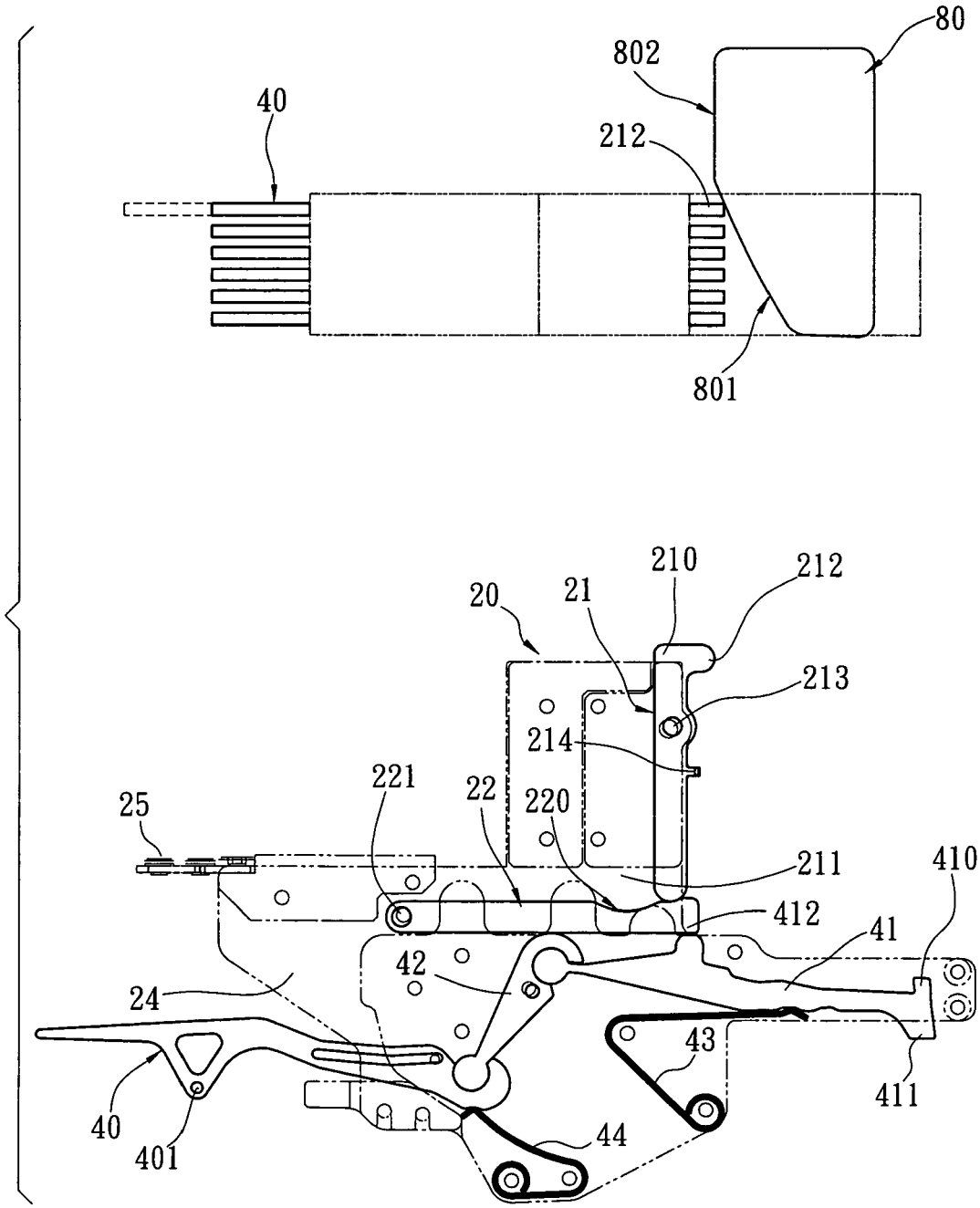
Figure 5F:
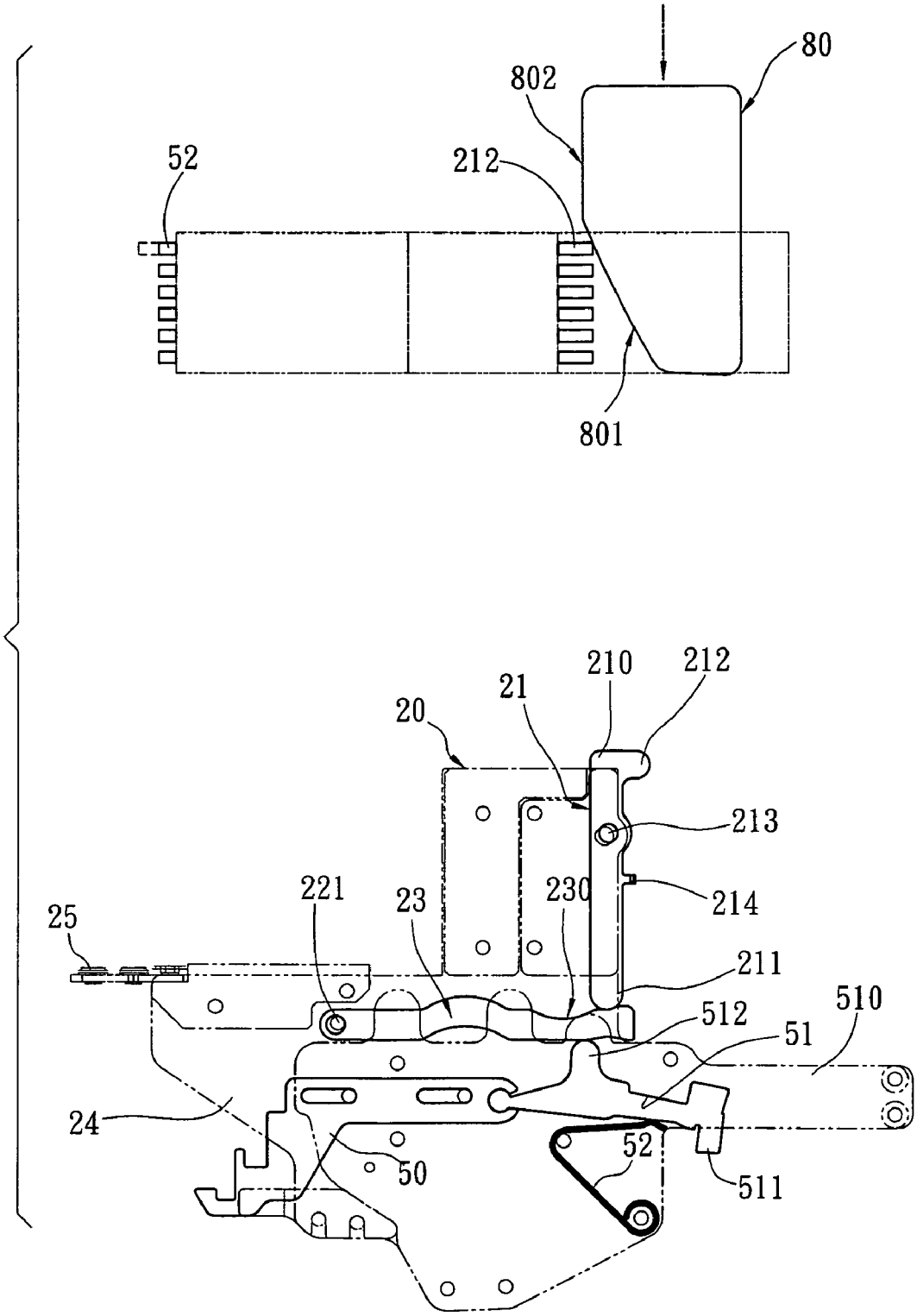

As shown in FIG. 5E, the return cam 80 moves to the controller 20 again, and the front inclined plane 801 of the return cam 80 gradually closes to the return nose 212 of the trigger 21, and the rear plane 802 of the return cam 80 pushes the trigger 21 to the normal lock position to actuate the backward-stroke protuberance 411 of the first connecting rod 41 to emerge from below the sideboard 24. Simultaneously, as shown in FIG. 5F, the backward-stroke protuberance 511 of the driving link 51 also emerges from below the sideboard 24.

Figure 5G:
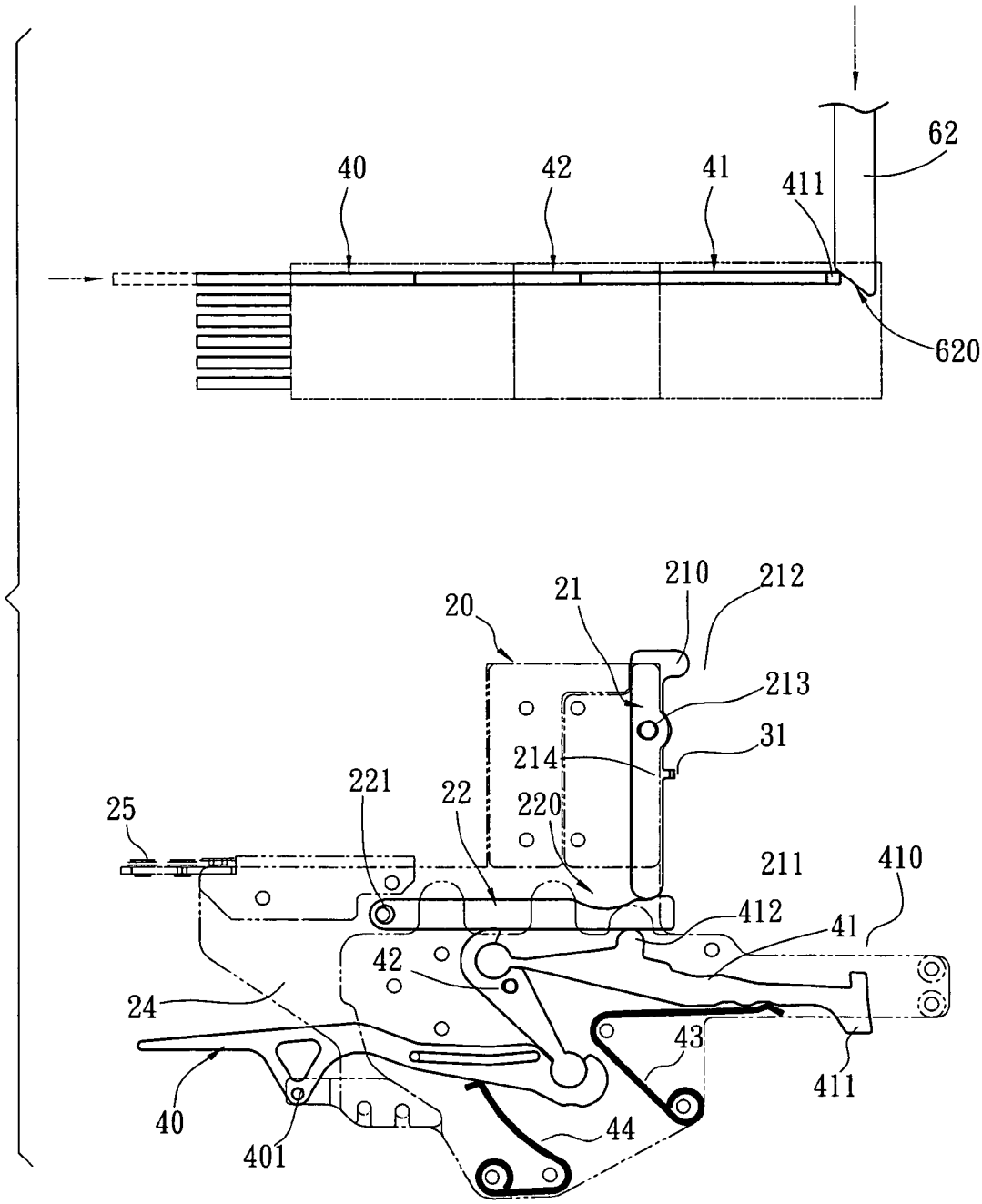
Figure 5H:
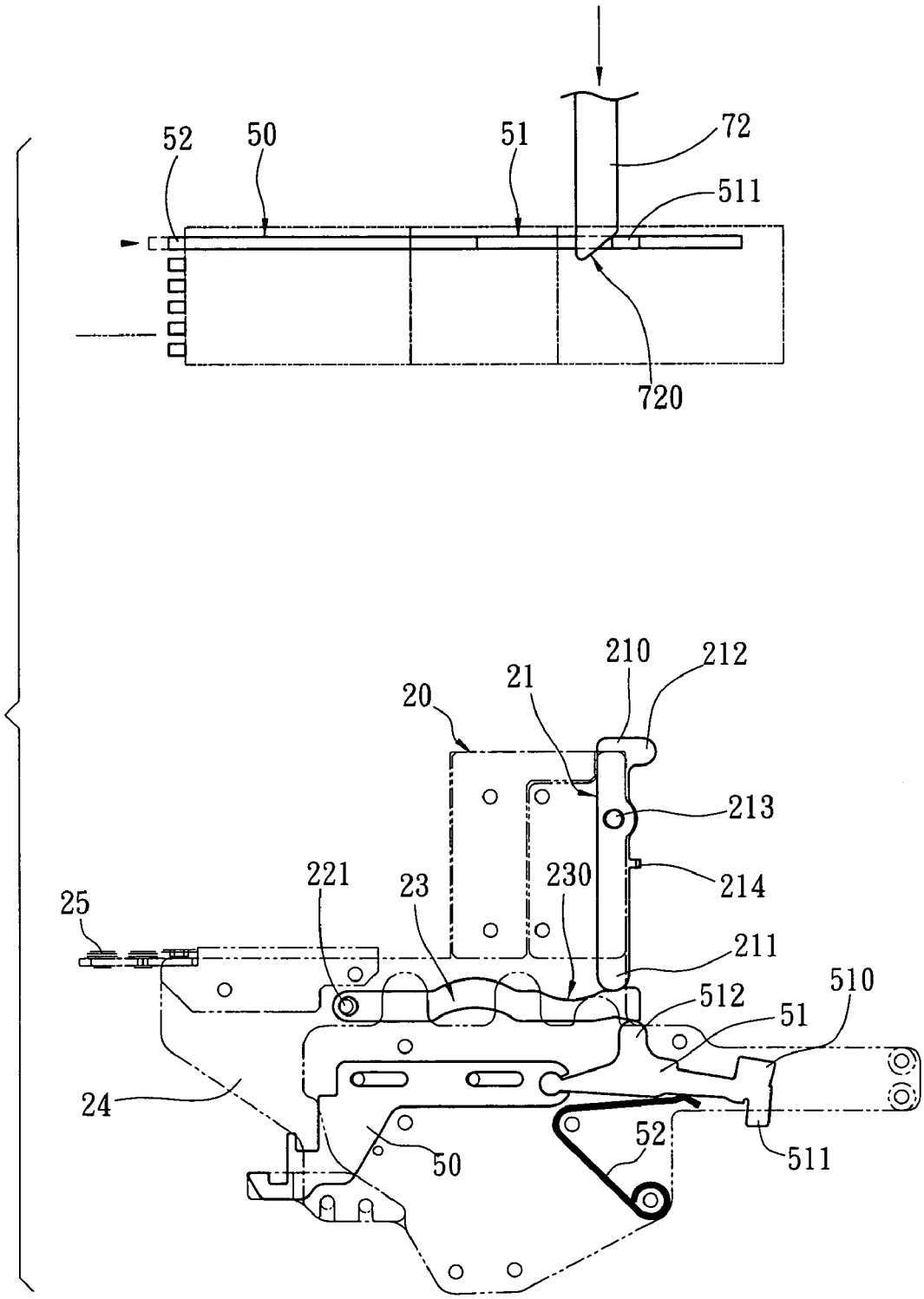

Lastly, as shown in FIG. 5G, the drive unit moves to the yarn-feed unit again, and the first inclined plane 620 of the backward cam 62 of the first cam set 60 touches the backward-stroke protuberance 411 of the first connecting rod 41 to actuate the first connecting rod 41 and the second connecting rod 42 to pull the yarn-changing plate 40 back to the normal non-enable position. Further, as shown in FIG. 5H, the first inclined plane 720 of the backward cam 72 of the second cam set 70 also touches the backward-stroke protuberance 511 of the driving link 51 to actuate the driving link 51 to pull the movable blade 50 back to the normal holding position; at this time, the hook 502 at the front end of the movable blade 50 for clipping/cutting yarns will not only clip the tail of the yarn Y to position it at between the hook 502 and the sideboard 24 but also will cut off the yarn Y.

The time difference between the action of the backward cam 62 of the first cam set 60 and the action of the backward cam 72 of the second cam set 70, i.e. the time difference between that the first inclined plane 620 touches the backward-stroke protuberance 411 and that the first inclined plane 720 touches the backward-stroke protuberance 511, can be adjusted according to demand. A practical method is installing the backward cams 62, 72 separately at cam seats 63, 64; such a design can make an old yarn be quickly withdrawn and cut off when striping (changing a yarn) and make the tail of a new yarn be released from the movable blade 50 before the new yarn is torn off lest the yarn be torn off and yarnlets appear; thereby, fabric quality can be improved.

A preferred embodiment of the forward cam 71 of the second cam set 70 show in FIG. 3 is a two-stage cam, which further comprises: a static cam 73 and a movable cam 74, wherein the first inclined plane 710 is positioned at the front end of the static cam 73, and the movable cam 74 further has a second inclined plane 730. The static cam 73 and the movable cam 74 are separately positioned at different heights. The movable cam 74 is fixed to the forward cam 71 with a screw 741, and after the screw 741 is loosened, the relative position of the movable cam 74 and the static cam 73 can be adjusted. The abovementioned forward-stroke protuberances of the multiple driving links of the yarn-feed unit are also divided into two kinds of forward-stroke protuberances 510, 510*a*, and the forward-stroke protuberance 510 can be pushed by the first inclined plane 710 of the static cam 73, and the forward-stroke protuberance 510*a* can be pushed by the second inclined plane 730 of the movable cam 74.

Figure 6:
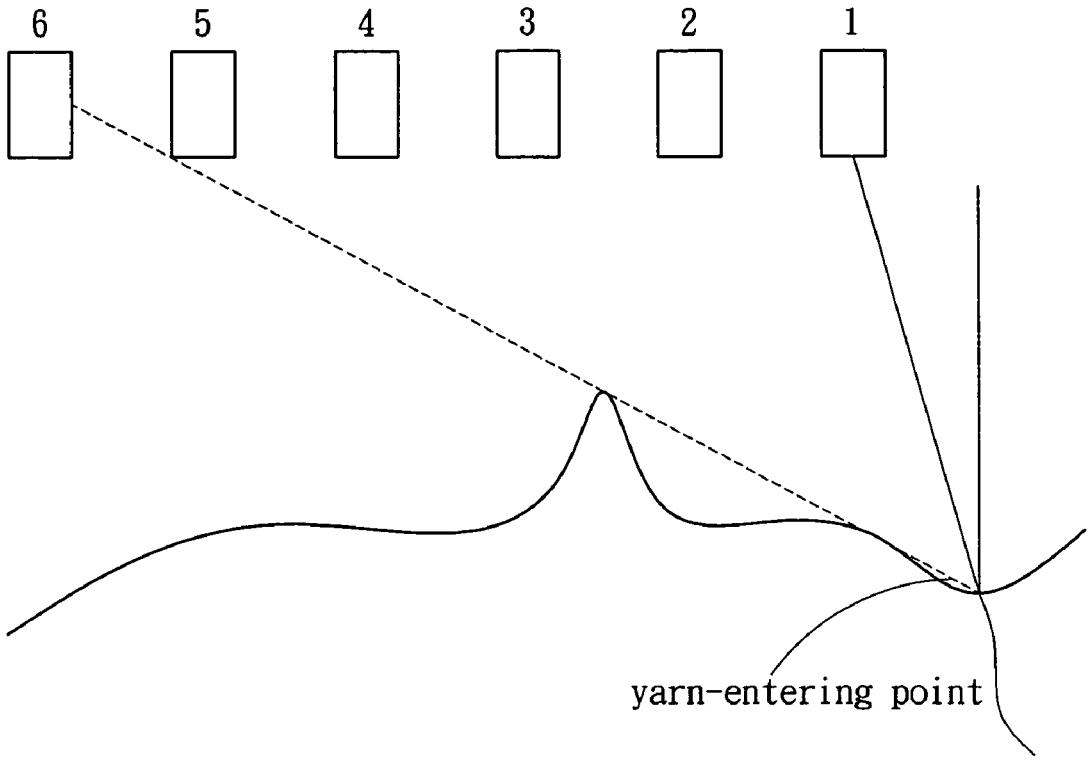
FIG. 6 is a schematic view showing the relative positions of old yarn, new yarn and the yarn-entering point of the knitting needle when yarn is changed.
Figure 7:
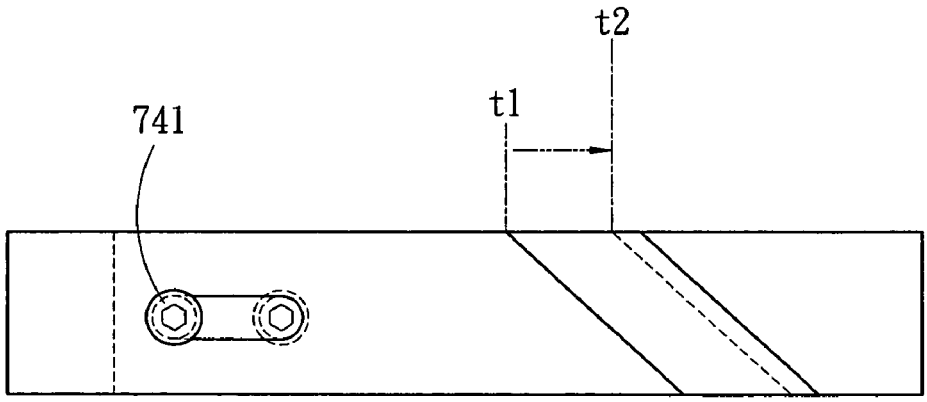
FIG. 7 is a schematic view showing a preferred embodiment of the forward cam of the second cam set of the present invention.

Refer to FIG. 6, wherein the present invention is exemplified by a six-color striping apparatus. Suppose that the old yarn is the yarn 6 and the new yarn is the yarn 1 herein; when the knitting needle moves to the yarn-entering point shown in FIG. 6, the movable cam 74 can be moved forward to advance the timing that the second inclined plane 730 touches the backward protuberance 511 from time t1 to time t2 shown in FIG. 7 lest the old yarn be released by the movable blade 50 too late and the old yarn be torn off.

What is claimed is:

1. A striping apparatus of a circular knitting machine, comprising:

a controller, a yarn-feed unit, and a drive unit, wherein said controller is driven by a selector that rotates around the knitting portion of said circular knitting machine, and characterized in:

that said yarn-feed unit has two portions; the first portion further comprises: a yarn-changing plate, a first connecting rod and a second connecting rod, and is used to feed a yarn Y to a yarn-entering position; the second portion further comprises: a movable blade and a driving link, and is used to clip the tail end of the yarn Y in standby state and to cut off an old yarn when changing a yarn in order to release said old yarn from fabric and restore said standby state; and that said drive unit and said selector rotate around the knitting portion of said circular knitting machine; said drive unit further comprises: a first cam set, a second cam set; said yarn-changing plate and said movable blade are separately actuated by said first cam set and said second cam set; said first cam set and said second cam set further respectively comprise forward cams and backward cams; said forward cam of said first cam set is responsible for pushing said yarn-changing plate to an external position; said forward cam of said second cam set is responsible for pushing said movable blade to an external release position; said backward cam of said first cam set is responsible for pulling said yarn-changing plate back to a normal position; said backward cam of said second cam set is responsible for pulling said movable blade back to a normal holding position.

2. The striping apparatus of a circular knitting machine according to claim 1, wherein both sides of the head end of said first connecting rod respectively have an upward forward-stroke protuberance and a downward backward-stroke protuberance; said forward-stroke protuberance is actuated by said forward cam of said first cam set, and said backward-stroke protuberance is actuated by said backward cam of said first cam set; the tail end of said second connecting rod is coupled to the tail end of said yarn-changing plate in order to actuate said yarn-changing plate to reciprocate between said normal position and said external position.

3. The striping apparatus of a circular knitting machine according to claim 1, wherein the tail end of said movable blade of said second portion is coupled to the tail end of said driving link; both sides of the head end of said driving link respectively have an upward forward-stroke protuberance and a downward backward-stroke protuberance; said forward-stroke protuberance is actuated by said forward cam of said second cam set, and said backward-stroke protuberance is actuated by said backward cam of said second cam set; thereby, said movable blade is actuated to reciprocate between said normal holding position and said external release position.

4. The striping apparatus of a circular knitting machine according to claim 1, wherein said forward cam of said second cam set further comprises: a static cam and a movable cam; a first inclined plane is positioned at the front end of said static cam, and said movable cam further has a second inclined plane; said static cam and said movable cam are separately positioned at different heights; said forward-stroke protuberances of multiple said driving links of said yarn-feed unit have two kinds of forward-stroke protuberances at different heights; the higher one of said forward-stroke protuberances is pushed by said first inclined plane of said static cam, and the lower one of said forward-stroke protuberances is pushed by said second inclined plane of said movable cam.

5. The striping apparatus of a circular knitting machine according to claim 4, wherein said movable cam is fixed to said forward cam with a screw, and after said screw is released, the relative position of said movable cam and said static cam can be adjusted.

* * * * *